US008328914B2

(12) United States Patent
Batrol

(10) Patent No.: US 8,328,914 B2
(45) Date of Patent: Dec. 11, 2012

(54) ADSORPTION BOX FOR SINGLE DISTILLATION COLUMN WITHIN THE INSULATING ENCLOSURE

(75) Inventor: Raymond Batrol, Les Ormes (FR)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 440 days.

(21) Appl. No.: 12/679,728

(22) PCT Filed: Sep. 25, 2008

(86) PCT No.: PCT/EP2008/062850

§ 371 (c)(1),
(2), (4) Date: Mar. 24, 2010

(87) PCT Pub. No.: WO2009/040396

PCT Pub. Date: Apr. 2, 2009

(65) Prior Publication Data

US 2010/0200389 A1 Aug. 12, 2010

(30) Foreign Application Priority Data

Sep. 26, 2007 (EP) ..... 07117236

(51) Int. Cl.
*B01D 53/02* (2006.01)

(52) U.S. Cl. ..... 96/108; 96/147; 96/154; 96/134; 95/117

(58) Field of Classification Search ..... 96/108, 96/147, 154; 95/117, 121; 202/259
See application file for complete search history.

(56) References Cited

U.S. PATENT DOCUMENTS

| | | | | |
|---|---|---|---|---|
| 2,986,891 | A * | 6/1961 | McMahon | 62/47.1 |
| 3,108,706 | A | 10/1963 | Matsch et al. | |
| 3,311,355 | A * | 3/1967 | Rait | 261/2 |
| 4,215,798 | A * | 8/1980 | Patterson et al. | 220/560.12 |
| 4,704,068 | A | 11/1987 | Theiben et al. | |
| 6,087,581 | A | 7/2000 | Emmer et al. | |

FOREIGN PATENT DOCUMENTS

GB 2139311 11/1984

OTHER PUBLICATIONS

Search Report for PCT/EP2008/062850.

* cited by examiner

*Primary Examiner* — Duane Smith
*Assistant Examiner* — Christopher P Jones
(74) *Attorney, Agent, or Firm* — Elwood L. Haynes; Justin K. Murray

(57) ABSTRACT

A apparatus for substantially dehumidifying an insulating annular space (108) is provided. This apparatus includes an insulated surrounding envelope (106), an inner cylindrical device (107) and a partial annular cylinder (100) comprising at least two porous zones. This apparatus positions the partial annular cylinder (100) within the insulating annular space (108) that is formed by the inner cylindrical device (107) positioned within the insulated surrounding envelope (106). This partial annular cylinder (100) holds adsorbent.

20 Claims, 4 Drawing Sheets

ADSORPTION BOX FOR SINGLE DISTILLATION COLUMN WITHIN THE INSULATING ENCLOSURE

This application is a §371 of International PCT Application PCT/EP2008/062850, filed Sep. 25, 2008.

BACKGROUND

There are many devices or assemblies that incorporate an insulating region. Often, within this insulating region is an active element, whose purpose is to reduce or remove moisture from this region. If this insulating region is maintained in an evacuated state, it is important to reduce or remove moisture in order to avoid problems with vacuum pumping. There is a need within the industry for a moisture removal device that ensures the desiccation of the vacuum insulating region.

The process in the present application is directed to a moisture removal device that satisfies the need in society in general for a moisture removal device that ensures the desiccation of the vacuum insulating region.

U.S. Pat. No. 3,108,706 discloses a system wherein a partial vacuum insulating space is created within an annular area. The problem that this patent addresses is the release into the vacuum of hydrogen by the metal itself. An adsorption agent is introduced into this insulating space that is specifically selective to adsorb hydrogen.

UK 2,139,311 discloses a system that also addresses the release of hydrogen into the vacuum by the metal itself. An adsorption device is either spirally wound around one of the surfaces, or the adsorption material is formed into a sintered body and inserted into this space. Either system is designed to be heated externally to regenerate the adsorbent. This system requires special manufacturing, construction and operating procedures as well as specialized adsorbent, which can not be easily replaced at the end of its useful life. It is not easily retrofitted into existing systems.

U.S. Pat. No. 4,704,068 discloses a system wherein a partial vacuum insulating space is created within an annular area. An adsorption agent is sealed in a gas-and-moisture tight container, introduced into this insulating space, and ruptures upon the final evacuation of the partial vacuum insulating space. This system requires special manufacturing, and operating procedures, which must be repeated every time the adsorbent reaches the end of its useful life. It also may not be easily retrofitted into all existing systems.

U.S. Pat. No. 6,087,581 discloses a system wherein a partial vacuum insulating space is created within an annular area, and wherein an adsorbent is placed in physical and thermal contact with the outer containment wall, such that the thermally regenerable adsorbent may be heated through the outer containment wall to regenerate the adsorbent. This system requires special manufacturing, construction and operating procedures as well as specialized adsorbent, which can not be easily replaced at the end of its useful life. It is not easily retrofitted into existing systems.

SUMMARY OF THE INVENTION

The goal of the present invention is to improve upon previously known systems. The instant invention is essentially characterized as an apparatus for substantially dehumidifying an insulating annular space comprising:

an insulated surrounding envelope, an inner cylindrical device, a partial annular cylinder comprising at least two porous zones, wherein said partial annular cylinder is positioned within an insulating annular space formed by said inner cylindrical device positioned within said insulated surrounding envelope, and wherein said partial annular cylinder holds absorbent.

Such an apparatus solves the problem of need for a moisture removal device that ensures the desiccation of the vacuum insulating region. Such an apparatus allows for easy retrofitting into existing systems, requires no specialized manufacturing or operating procedures, and allows for easy removal and replacement when the adsorbent has reached the end of its useful life. Such a system would allow the external regeneration of the adsorbent if necessary, and would not require any in situ heating to regenerate the adsorbent.

Moreover, other embodiments may comprise one or more of the following features.

Said inner cylindrical device may be concentrically positioned within said insulated surrounding envelope. Said partial annular cylinder may have a radial axis defined by the annular cross section, and two longitudinal cross sections that are defined by the longitudinal axis, wherein said longitudinal axis is normal to said radial axis.

Said annular cross section may be further defined by an inner radius and an outer radius. Said longitudinal cross sections may be further defined by an inner edge, an outer edge, a distal edge and a proximal edge.

Said truncated annular cross section may comprise a semicircle. Said truncated annular cross section may comprise a major arc. Said major arc may have an inscribed angle of between 180 degrees and 270 degrees. Said major arc may have an inscribed angle of between 200 degrees and 250 degrees. Said major arc may have an inscribed angle of between 200 degrees and 230 degrees.

Any gas or vapor present within said annular space may contact said absorbent. Said gas or vapor may comprise air. Said inner cylindrical device may comprise a single distillation column. Said insulating annular space may be substantially evacuated. Said at least two porous zones may be located at said longitudinal cross sections. Said porous zones may comprise a permeable mesh barrier.

Said permeable mesh barrier may be secured to said partial annular cylinder by means of a plurality of fasteners positioned along the perimeter of said porous zone. Said fasteners may be selected from the group consisting of rivets, bolts, and screws.

Said partial annular cylinder may have an internal volume of 0.03 cubic meters, preferably 0.04 cubic meters. Said partial annular cylinder may have an internal volume of 0.04 cubic meters, preferably 0.05 cubic meters. Said partial annular cylinder may have an internal volume of 0.06 cubic meters, preferably 0.07 cubic meters

BRIEF DESCRIPTION OF THE FIGURES

The invention may be understood by reference to the following description taken in conjunction with the accompanying drawings, and in which.

DETAILED DESCRIPTION OF THE INVENTION

Figure 1A:
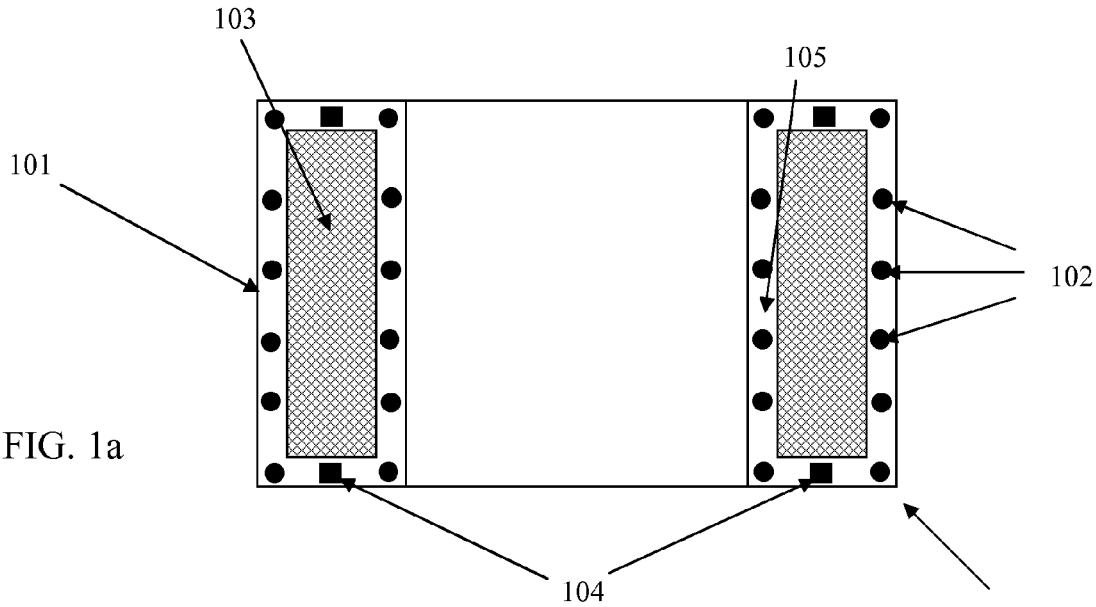
FIG. 1*a* is a schematic front view of one embodiment of the current invention.

For a further understanding of the nature and objects for the present invention, reference should be made to the detailed description, taken in conjunction with the accompanying drawing, in which like elements are given the same or analogous reference numbers and wherein:

Illustrative embodiments are described below. While the process in the present application is susceptible to various modifications and alternative forms, specific embodiments thereof have been shown by way of example in the drawings and are herein described in detail.

The following examples and embodiments are directed toward, but not limited to, a single column distillation apparatus of an air separation unit.

As used herein, the term "substantially dehumidify" is defined as removing sufficient moisture from any atmosphere that may be present, as to result in a relative humidity of less than 5%, preferably less than 1%, even more preferably less than 0.1%.

As used herein, the term "substantially evacuated" is defined as having sufficient atmosphere removed to result in a pressure of less than 10 Pa, preferably less than 1 Pa, even more preferably less than 0.1 Pa.

Figure 1B:
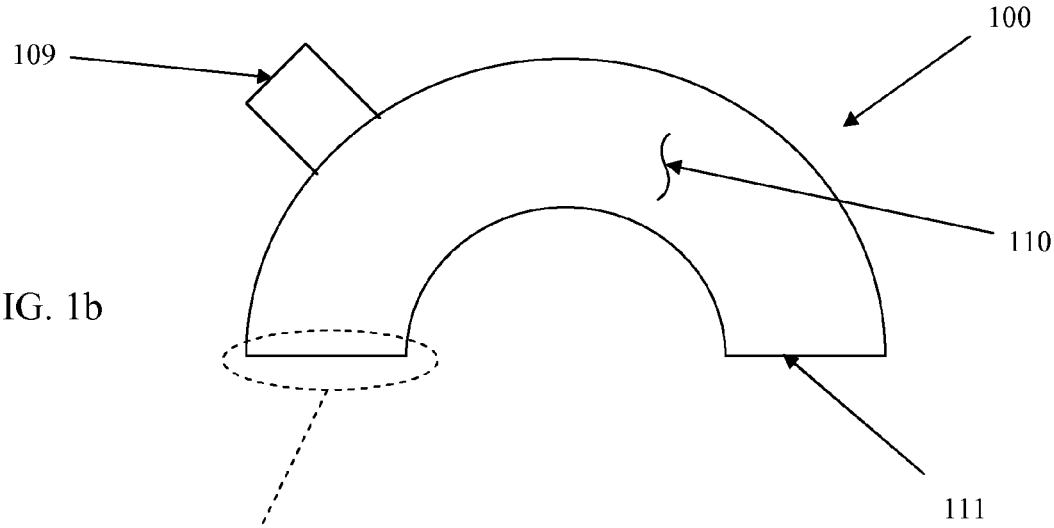
FIG. 1*b* is a schematic top view of an embodiment of the current invention.
Figure 1C:
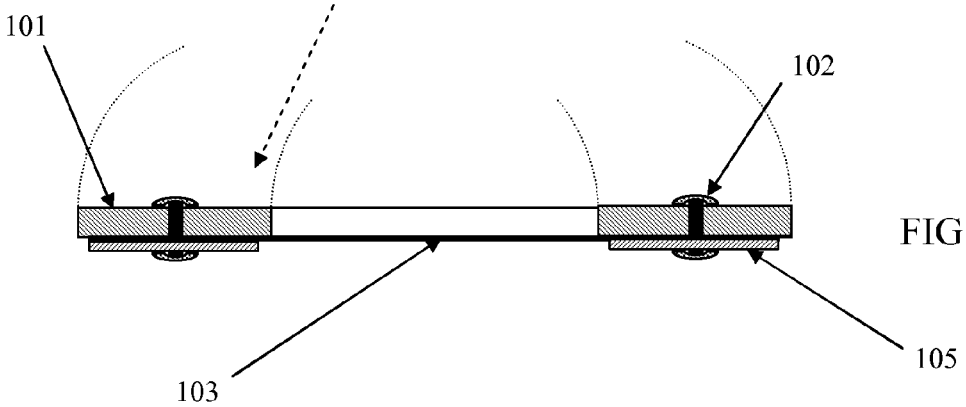
FIG. 1*c* is a schematic detail of the end of an embodiment of the current invention.

Now turning to FIGS. 1*a*, 1*b*, and 1*c*, an adsorption box 100 in accordance with embodiments of the present invention is illustrated. The adsorption box 100 comprises porous zones 101, fasteners 102, 104, frame 105, and permeable mesh barriers 103.

As indicated in FIG. 1*a*, porous zone 101 comprises an opening in the end of adsorption box 100 that is covered by a permeable mesh barrier 103. This permeable mesh barrier 103 allows gases and vapors to pass through, while containing adsorbent within the adsorption box 100. This adsorbent may be silica gel or activated alumina. Permeable mesh barrier 103 is attached to adsorption box 103 by means of frame 105, which is rigidly secured to adsorption box 100 by means of fasteners 102 and 104.

Permeable mesh barriers 103 may be comprised of any suitable material known to the skilled artisan. Permeable mesh barriers 103 may be fabricated as part of frame 105, thus facilitating the secure attachment to the body of adsorption box 100 with fasteners 102, 104.

FIG. 1*b* is a schematic top view of one embodiment of the present invention, illustrating the radial cross section of the truncated annular cylindrical shape of one embodiment of adsorption box 100. This view illustrates filler portal 109, which is used to load adsorbent 110 into adsorption box 100. From this view, longitudinal cross sections 111 are illustrated as the faces of the truncated annular cylinder. Porous zones 101 are located at these longitudinal cross sections 111.

FIG. 1*c* is a schematic view of one embodiment of the present invention, illustrating a detailed view of porous zone 101 as illustrated in FIG. 1*b*. From this view, one embodiment of the attachment of permeable barrier 103 to the body of adsorption box 100 may be seen. With permeable mesh barrier 103 positioned between the body of adsorption box 100 and frame 105, fasteners 102 and 104 (not shown for clarity) are used to secure the frame and permeable barrier to the body of adsorption box 100.

Figure 2A:
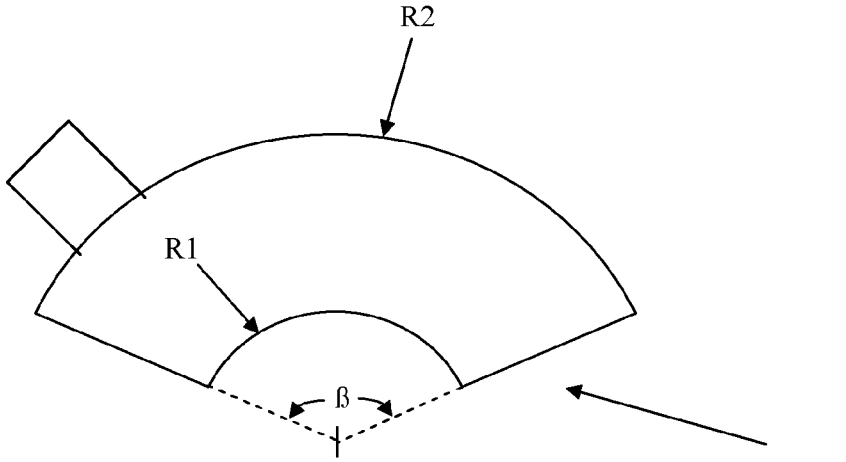
FIG. 2*a* is a schematic top view of an embodiment of the current invention.
Figure 2B:
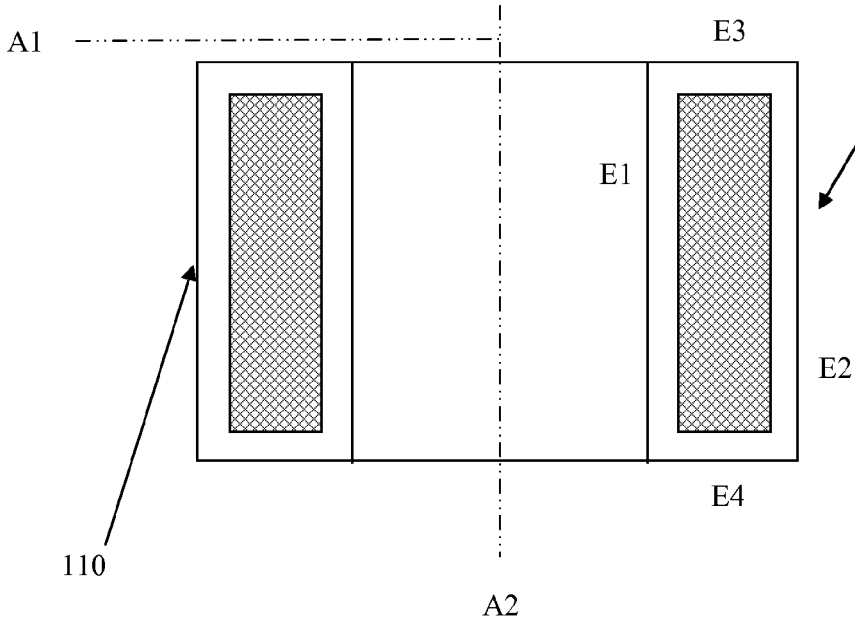
FIG. 2*b* is a schematic front view of an embodiment of the current invention.

As indicated in FIGS. 2*a* and 2*b*, adsorption box 100 comprises a hollow annular cylinder, with an annular radial cross-section. FIG. 2*a* presents a schematic top view of one embodiment of the present invention similar to the view shown in FIG. 1*b*. This annular cylinder is radially truncated so that the annular cross section may be in the form of a semicircle. This annular cross section may comprise a major arc, wherein said major arc has an inscribed angle β of between 180 degrees and 270 degrees. Said major arc may have an inscribed angle β of between 200 degrees and 250 degrees. Said major arc may have an inscribed angle β of between 200 degrees and 230 degrees. This annular cross section may comprise a minor arc, wherein said minor arc has an inscribed angle β of between about 90 degrees and about 180 degrees FIG. 2*b* presents a front schematic view of one embodiment of the present invention, similar to the view shown in FIG. 1*a*. This annular cylinder face comprises a longitudinal axis A2 that lies perpendicular to the radial axis A1 of the annular cross section. In one embodiment, fasteners are positioned along inner edge E1 and outer edge E2 of the face of said truncated annular cylinder. In one embodiment, fasteners are positioned along inner edge E1, outer edge E2, distal edge E3, and proximal edge E4. Fasteners 102 and 104 may be rivets, bolts, screws, or any other attaching means known to the skilled artisan.

Figure 3:
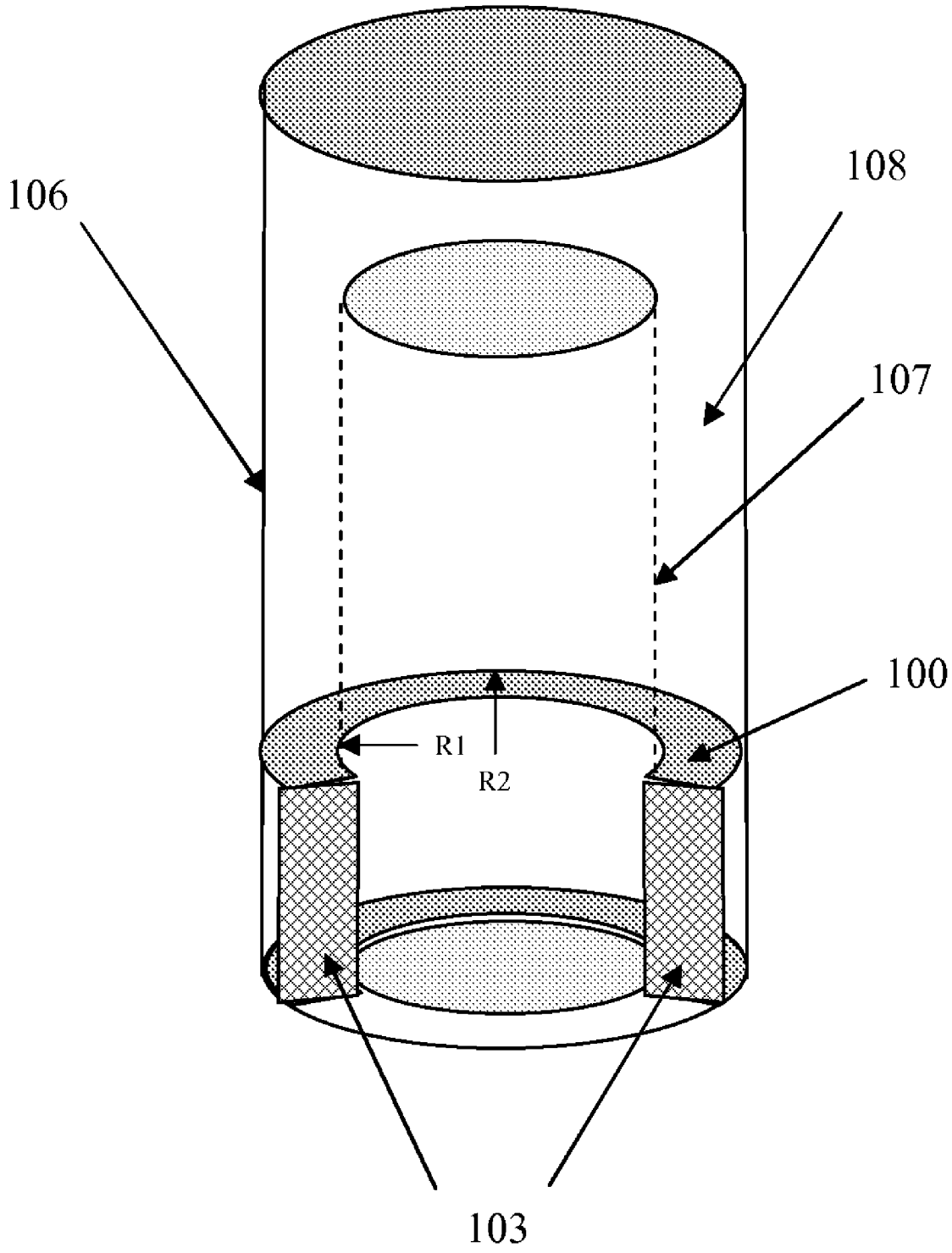
FIG. 3 is an isometric illustration of an embodiment of the current invention.

As indicated in FIGS. 2*a* and 3, adsorption box 100 is defined by an inner radius R1 and an outer radius R2. the truncated ends are defined by longitudinal cross-sections sections 111, wherein said longitudinal cross-sections 111 are further defined by an inner edge E1, an outer edge E2, a distal edge E3, and a proximal edge E4.

Figure 4:
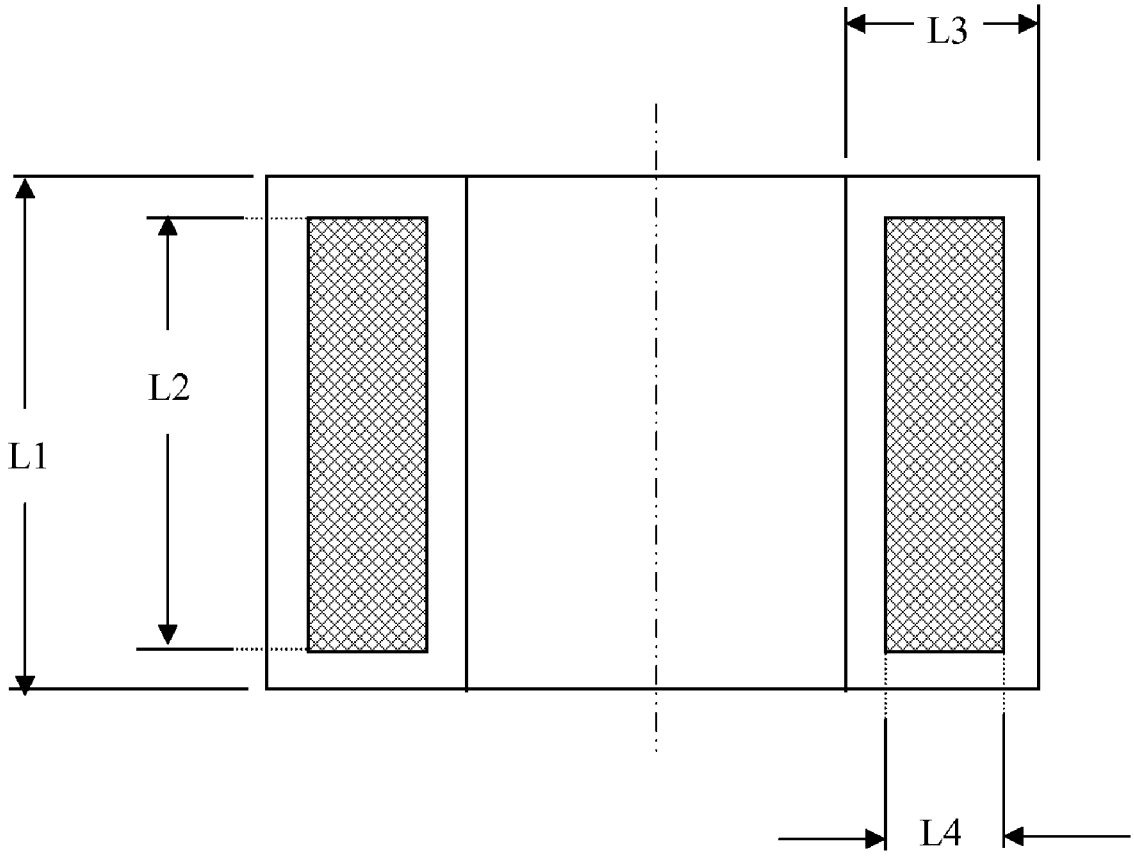
FIG. 4 is a front view of an embodiment of the current invention.

As indicated in FIG. 4, adsorption box 100 is defined by a longitudinal annual cylinder length of L1. The truncated ends are defined by either a distal end E3, a proximal end E4, or both, having a width of L3. In one embodiment, the width of the distal end E3 is unequal to the width of the proximal end E4. Also indicated in FIG. 4, permeable mesh barrier 103 is defined by a longitudinal length of L2 and an axial width of L4.

As indicated in FIG. 3, according to one embodiment, an operative unit 107, in this particular example the column, is supported inside the surrounding envelope 106, in this particular example the cold box. The annular region 108 that includes the volume that is outside the operative unit 107 and still inside the surrounding envelope 106 is substantially evacuated. Adsorption box 100 is used to adsorb any humidity that may be present inside the cold box 106, prior to lowering the pressure within this evacuated region 108.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus for substantially dehumidifying an insulating annular space comprising: an insulated surrounding envelope, an inner cylindrical device, an insulating annular space formed by positioning said inner cylindrical device within said insulated surrounding envelope, a partial annular cylinder comprising at least two porous zones, wherein said partial annular cylinder is positioned within said insulating annular space, and wherein said partial annular cylinder holds adsorbent.

2. The apparatus of claim 1, wherein said inner cylindrical device is concentrically positioned within said insulated surrounding envelope.

3. The apparatus of claim 1, wherein said partial annular cylinder has a radial axis defined by an annular cross section, and two longitudinal cross sections that are defined by a longitudinal axis, wherein said longitudinal axis is normal to said radial axis.

4. The apparatus of claim 3, wherein said annular cross section comprises a truncated annular cross section.

5. The apparatus of claim 4, wherein said truncated annular cross section comprises a semicircle.

6. The apparatus of claim 4, wherein said truncated annular cross section comprises a major arc.

7. The apparatus of claim 6, wherein said major arc has an inscribed angle (β) of between 180 degrees and 270 degrees.

8. The apparatus of claim 6, wherein said major arc has an inscribed angle (β) of between 200 degrees and 250 degrees.

9. The apparatus of claim 6, wherein said major arc has an inscribed angle (β) of between 200 degrees and 230 degrees.

10. The apparatus of claim 3, wherein said at least two porous zones are located at said longitudinal cross sections.

11. The apparatus of claim 10, wherein said porous zones comprise a permeable mesh barrier.

12. The apparatus of claim 11, wherein said permeable mesh barrier is secured to said partial annular cylinder by means of a plurality of fasteners positioned along the perimeter of said porous zone.

13. The apparatus of claim 12, wherein said fasteners may be selected from the group consisting of rivets, bolts, and screws.

14. The apparatus of claim 1, wherein said inner cylindrical device is a single distillation column.

15. The apparatus of claim 1, wherein said insulating annular space is substantially evacuated.

16. The apparatus of claim 1, wherein said partial annular cylinder has an internal volume of at least 0.03 cubic meters.

17. The apparatus of claim 1, wherein said partial annular cylinder has an internal volume of at least 0.04 cubic meters.

18. The apparatus of claim 1, wherein said partial annular cylinder has an internal volume of at least 0.05 cubic meters.

19. The apparatus of claim 1, wherein said partial annular cylinder has an internal volume of at least 0.06 cubic meters.

20. The apparatus of claim 1, wherein said partial annular cylinder has an internal volume of at least 0.07 cubic meters.

* * * * *